US009366159B2

(12) United States Patent
Wigsten et al.

(10) Patent No.: US 9,366,159 B2
(45) Date of Patent: Jun. 14, 2016

(54) CONCENTRIC CAMSHAFT PHASER TORSIONAL DRIVE MECHANISM

(75) Inventors: Mark Wigsten, Lansing, NY (US); David C. White, Dryden, NY (US); James Sisson, Locke, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 134 days.

(21) Appl. No.: 14/005,354

(22) PCT Filed: Mar. 14, 2012

(86) PCT No.: PCT/US2012/028983

§ 371 (c)(1), (2), (4) Date: Oct. 2, 2013

(87) PCT Pub. No.: WO2012/134812

PCT Pub. Date: Oct. 4, 2012

(65) Prior Publication Data

US 2014/0158074 A1 Jun. 12, 2014

Related U.S. Application Data

(60) Provisional application No. 61/469,802, filed on Mar. 30, 2011, provisional application No. 61/480,898, filed on Apr. 29, 2011.

(51) Int. Cl.
*F01L 1/34* (2006.01)
*F01L 1/047* (2006.01)
(Continued)

(52) U.S. Cl.
CPC . *F01L 1/34* (2013.01); *F01L 1/026* (2013.01); *F01L 1/047* (2013.01); *F01L 1/352* (2013.01); *F01L 1/022* (2013.01); *F01L 1/344* (2013.01); *F01L 2001/0473* (2013.01); *Y10T 29/49293* (2015.01)

(58) Field of Classification Search
CPC . F01L 1/344; F01L 1/053; F01L 2001/34476; F01L 2001/34473; F01L 2001/34469; F01L 2001/34466; F01L 2001/34463; F01L 2001/34459; F01L 2001/34456; F01L 2001/34453; F01L 2001/3445; F01L 1/3442; F01L 2001/34486; F01L 2001/34489; F01L 2001/34493; F01L 2001/34496; F16D 3/74; F16D 7/044
See application file for complete search history.

(56) References Cited

U.S. PATENT DOCUMENTS 3,481,156 A 12/1969 De Csipkes
4,257,192 A 3/1981 Bartholomew
(Continued)

*Primary Examiner* — Thomas Denion
*Assistant Examiner* — Daniel Bernstein
(74) *Attorney, Agent, or Firm* — Helmholdt Law PLC; Thomas D. Helmholdt

(57) ABSTRACT

A variable cam timing assembly (10) and method for an internal combustion engine of a motor vehicle includes a cam phaser (22) connected between an inner camshaft (12*a*) and an outer camshaft (12*b*) of a concentric camshaft (12). A torsional drive mechanism (14) connects between the cam phaser (22) and the inner camshaft (12*a*) for transmitting rotational torque. The torsional drive mechanism (14) permits adjustment for perpendicularity and axial misalignment of the inner and outer camshafts (12*a*, 12*b*), while maintaining a torsionally stiff coupling between the cam phaser (22) and one of the inner and outer camshafts (12*a*, 12*b*) of the concentric camshaft (12). The torsional drive mechanism (14) can be formed from one of a flexible shaft coupling (40), a transversely split driven gear (140), a transversely split sprocket ring gear (240), a transverse face spline gear (340), and a pin and slot combination drive (440).

11 Claims, 6 Drawing Sheets

(51) Int. Cl.

| | |
|---|---|
| ***F01L 1/352*** | (2006.01) |
| *F01L 1/02* | (2006.01) |
| *F01L 1/344* | (2006.01) |

(56) References Cited

U.S. PATENT DOCUMENTS

| | | | | | |
|---|---|---|---|---|---|
| 4,280,339 | A * | 7/1981 | Stuemky | 464/88 |
| 4,779,471 | A | 10/1988 | Rettig | |
| 4,911,258 | A | 3/1990 | Muller | |
| 5,022,876 | A | 6/1991 | Etter | |
| 5,554,073 | A | 9/1996 | Yadama | |
| 5,592,909 | A | 1/1997 | Tsuruta | |
| 5,609,127 | A * | 3/1997 | Noplis | 123/90.17 |
| 6,053,137 | A * | 4/2000 | Trzmiel et al. | 123/90.17 |
| 6,418,897 | B1 * | 7/2002 | Urban et al. | 123/90.17 |
| 6,978,884 | B2 | 12/2005 | Lockwood | |
| 7,168,123 | B2 | 1/2007 | Ennis | |
| 7,562,763 | B2 | 7/2009 | Tabler | |
| 7,717,795 | B2 | 5/2010 | Mellor | |
| 8,113,159 | B2 | 2/2012 | Myers et al. | |
| 8,122,863 | B2 | 2/2012 | Myers | |
| 8,191,521 | B2 | 6/2012 | Kandolf et al. | |
| 8,485,150 | B2 * | 7/2013 | Schafer et al. | 123/90.17 |
| 2009/0183702 | A1 * | 7/2009 | Knecht et al. | 123/90.15 |
| 2009/0223469 | A1 * | 9/2009 | Rozario et al. | 123/90.17 |
| 2011/0079483 | A1 * | 4/2011 | Padovan | 192/54.3 |
| 2013/0032112 | A1 * | 2/2013 | Sisson et al. | 123/90.17 |
| 2014/0158074 | A1 * | 6/2014 | Wigsten et al. | 123/90.15 |
| 2014/0283773 | A1 * | 9/2014 | Elfers | 123/90.17 |

* cited by examiner

CONCENTRIC CAMSHAFT PHASER TORSIONAL DRIVE MECHANISM

FIELD OF THE INVENTION

The invention relates to rotational torque transmitted via a torsional drive mechanism for rotary camshafts, wherein the torsional drive mechanism can include a plurality of teeth or splines formed on a driving rotary member and a driven rotary member, or a flexible coupling having a flexible link body connect to a driving rotary member and a driven rotary member, and more particularly, to rotational torque transmitted via a cam phaser and concentric rotary camshafts for operating at least one poppet-type intake or exhaust valve of an internal combustion engine of a motor vehicle.

BACKGROUND

Variable valve-timing mechanisms for internal combustion engines are generally known in the art. For example, see U.S. Pat. No. 4,494,495; U.S. Pat. No. 4,770,060; U.S. Pat. No. 4,771,772; U.S. Pat. No. 5,417,186; and U.S. Pat. No. 6,257,186. Internal combustion engines are generally known to include single overhead camshaft (SOHC) arrangements, dual overhead camshaft (DOHC) arrangements, and other multiple camshaft arrangements, each of which can be a two-valve or a multi-valve configuration. Camshaft arrangements are typically used to control intake valve and/or exhaust valve operation associated with combustion cylinder chambers of the internal combustion engine. In some configurations, a concentric camshaft is driven by a crankshaft through a timing belt, chain, or gear to provide synchronization between a piston connected to the crankshaft within a particular combustion cylinder chamber and the desired intake valve and/or exhaust valve operating characteristic with respect to that particular combustion cylinder chamber. To obtain optimum values for fuel consumption and exhaust emissions under different operating conditions of an internal combustion engine, the valve timing can be varied in dependence on different operating parameters.

A concentric camshaft includes an inner camshaft and an outer camshaft. The two camshafts can be phased relative to each other using a mechanical device, such as a cam phaser, to vary the valve timing. Cain phasers require precise tolerances and alignment to function properly. Misalignment between the inner camshaft and the outer camshaft of the concentric camshaft can create problems preventing proper function of the can phaser. It would be desirable to provide an assembly capable of adapting to misalignment between inner and outer camshafts of a concentric camshaft and a can phaser. It would be desirable to provide an assembly capable of accommodating tolerance stack up and thereby resolving binding issues that adversely affect concentric camshaft and phaser system assemblies.

Flexible cable drive systems are generally known, see U.S. Pat. No. 7,717,795; U.S. Pat. No. 7,562,763; U.S. Pat. No. 7,168,123; U.S. Pat. No. 6,978,884; U.S. Pat. No. 5,554,073; U.S. Pat. No. 5,022,876; U.S. Pat. No. 4,911,258; U.S. Pat. No. 4,779,471; U.S. Pat. No. 4,257,192; and U.S. Pat. No. 3,481,156. In a typical rotatable flexible shaft, a wire mandrel has a plurality of layers of closely coiled wire wound there over, each of the layers being successively wound over another in alternately opposing directions, i.e., right or left-hand lay. This shaft is usually covered by a flexible casing, metallic or covered, and a clearance between the shaft and casing is provided in order that the shaft may rotate freely within the casing. These flexible cable drive systems are typically used for light duty power transmission, such as speedometer cables, power seat adjustment, and marine propulsion applications. It would be desirable to provide an assembly capable of adapting to misalignment between inner and outer camshafts of a concentric camshaft and a cam phaser.

SUMMARY

A concentric camshaft includes two shafts; an inner shaft and an outer shaft. The two shafts are phased relative to each other using a mechanical device such as a cam phaser. Cam phasers require precise tolerances and alignment to function properly. A problem can exist with respect to the alignment of the inner shaft to the outer shaft of the concentric camshaft. A torsional drive mechanism can correct this problem when mounted between the phaser rotor and the inner shaft. The torsional drive mechanism allows for the phaser to adjust for perpendicularity, and axial misalignment, while maintaining a torsionally stiff coupling.

The torsional drive mechanism is intended to solve a tolerance stack-up binding problem that can exist when a cam phaser is attached to both parts of a concentric camshaft. To account for misalignment of the shafts and perpendicularity tolerances of the phaser parts as the parts are mounted to the inner and outer shafts of the concentric cam, a torsionally rigid/axially compliant coupling is required. The idea presented includes torsion drive mechanisms having at least one of a combination pin/slot drive mechanism located between the outer shaft and the phaser assembly, a single driving gear/dual driven gear drive mechanism (sometimes referred to herein as a transversely split gear drive mechanism), a single endless loop flexible driving member/dual driven sprocket ring gear drive (sometimes referred to herein as a transversely split sprocket ring gear drive mechanism), and a transverse face spline drive located between a sprocket ring gear and an end plate of the phaser assembly.

The torsional drive mechanism can include a plurality of teeth or splines formed between a driving member and a driven member for a concentric camshaft. The torsional drive mechanism allows for misalignment of the inner shaft to rotor joint. If the misalignment of the inner shaft to rotor joint was not corrected, the rotor could bind within the housing portion of the cam phaser assembly.

The pin drive connection can use a simple pin as a torsional drive member between a cam phaser and one of the shafts of a concentric camshaft system. The pin can be press fit into a mating part on one side and can have an outer end of the pin with a slip fit with respect to a slot formed in another complementary part. This allows torque to be transmitted through the pin while also allowing some tipping or axial nm out between the parts as the system rotates.

The transversely split spur gear or transversely split sprocket ring gear design can also transmit torque between the cam phaser and the concentric camshaft system while allowing some axial motion between the two. This is done by separating the phaser and cam, which are usually rigidly fastened together, and instead driving a separate, individual spur or pinion gear or separate, individual sprocket ring gear for each of the phaser and cam with a single common driving gear or endless loop flexible power transmission member.

The transverse face spline connection between the drive sprocket ring gear and the end plate of the phaser assembly can allow for misalignment between the two components while still allowing torque transfer between the components. This "compliant" joint is needed to provide a flexible joint to allow for misalignment between the inner and outer shaft of a concentric camshaft. The transverse face spline allows typically longer meshing surfaces than a spline on a longitudinal or axial surface. This in turn decreases the amount of backlash required to take up the same amount of parallelism error. Transverse face splines can typically be found in the application of torque limiting devices. In those devices the two components would need to be displaced axially one from another. For this device, the axial positions will be maintained throughout operation, therefore only allowing take-up of parallelism errors due to tolerances.

The torsion drive mechanism permits assembly of a concentric cam based camshaft phaser while allowing misalignment of components as caused by manufacturing tolerances. In the transverse face spline connection case, the misalignment is meant to be taken up between the end plate of the phaser and the cam drive sprocket ring gear. By decoupling the end plate from the sprocket ring gear, the end plate is allowed to conform to the angular inclination of the rotor (as defined by the inner shaft). As the outer and inner end plates are bolted together through the phaser housing portion, the end plates can align to the rotor. The sprocket ring gear is affixed rigidly to the outer shaft of the camshaft assembly. The orientation of the inner to outer shaft, and subsequently the rotor, along with housing portion and end plates assembly, to the cam drive sprocket ring gear is provided by the cam lobes. Since the end plate of the assembly is held in close proximity to the cam drive sprocket ring gear, a face spline can be used between the two components to provide torque transmittal, while also allowing for slight differences in parallelism between the two. Backlash between the two components needs to be minimized to avoid poor noise, vibration, harshness (NVH) performance of the assembly.

The torsion drive mechanism can include a flex shaft coupling to correct the alignment problem between the inner shaft and the outer shaft of the concentric camshaft when mounted between the phaser rotor and the inner shaft. The flex shaft coupling allows for the phaser to adjust for perpendicularity, and axial misalignment, while maintaining a torsionally stiff coupling. The flexible shaft coupling can use a flexible cable shaft as a torsional drive member between the rotor and inner shaft of a concentric camshaft. The flexible shaft allows for misalignment of the inner shaft to rotor joint. If the misalignment of the inner shaft to rotor joint was not corrected, the rotor could bind within the housing of the cam phaser.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
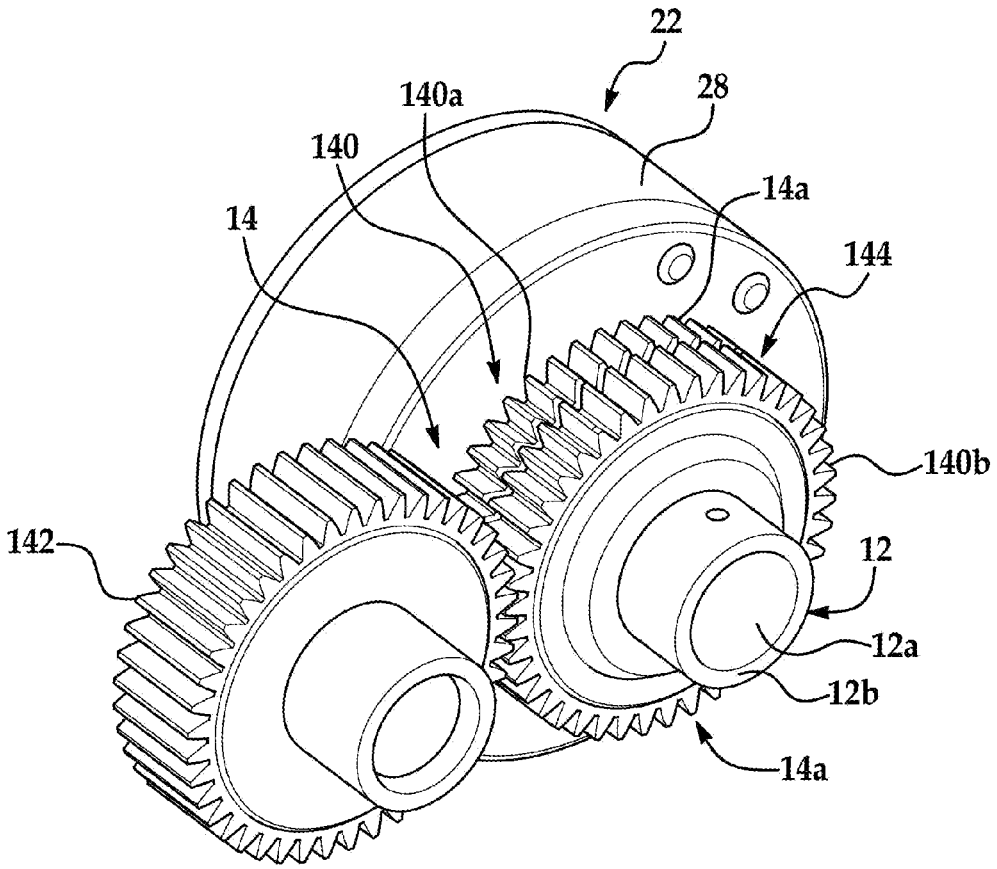
FIG. 1 is a perspective view of a cam phaser and concentric camshaft assembly including a housing portion, a rotor, a torsional drive mechanism, where the concentric camshaft has an inner camshaft and an outer camshaft.

Referring now to FIGS. 1-8, a portion of a variable cam timing (VCT) assembly 10 is illustrated including a concentric camshaft 12 having an inner camshaft 12*a* and an outer camshaft 12*b*. Primary rotary motion can be transferred to the concentric camshaft 12, while secondary rotary motion, or phased relative rotary motion between inner camshaft 12*a* and outer camshaft 12*b*, can be provided by a cam phaser or other mechanical actuator 22. The mechanical actuator or cam phaser 22 can be operably associated with an inner camshaft 12*a*. A rotor 36 can be pressed onto the inner camshaft 12*a* and secured with a pin. The rotor 36 can be enclosed within a housing portion 28 of the cam phaser 22. Cam phasers 22 require precise tolerances and alignment to function properly. Misalignment between the inner camshaft 12*a* and the outer camshaft 12*b* of the concentric camshaft 12 can create problems preventing proper function of the cam phaser 22.

A torsional drive mechanism 14 can be provided to compensate for misalignment between inner camshaft 12*a* and outer camshaft 12*b* of the concentric camshaft 12 and cam phaser 22. A torsional drive mechanism can be connected between the inner camshaft 12*a* and the outer camshaft 12*b* of the concentric camshaft 12 for transmitting rotational torque therebetween. The torsional drive mechanism 14 permits adjustment for perpendicularity and axial misalignment of the inner and outer camshafts 12*a*, 12*b*, while maintaining a torsionally stiff coupling between a cam phaser 22 and one of the inner and outer camshafts 12*a*, 12*b* of the concentric camshaft 12. The torsional drive mechanism 14 can include a plurality of driven teeth 14*a*.

Figure 2:
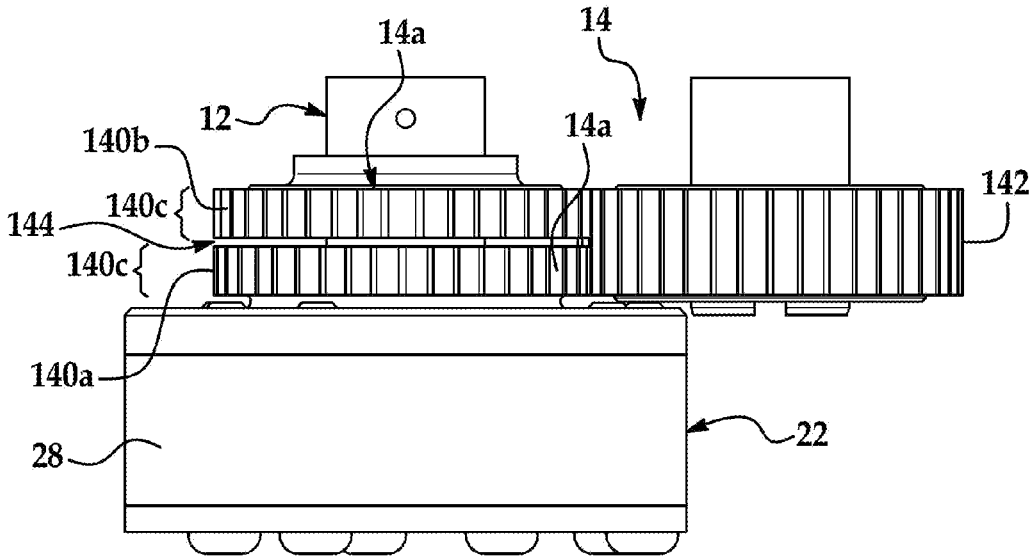
FIG. 2 is a plan view of the cam phaser and concentric camshaft assembly of FIG. 1.
Figure 3:
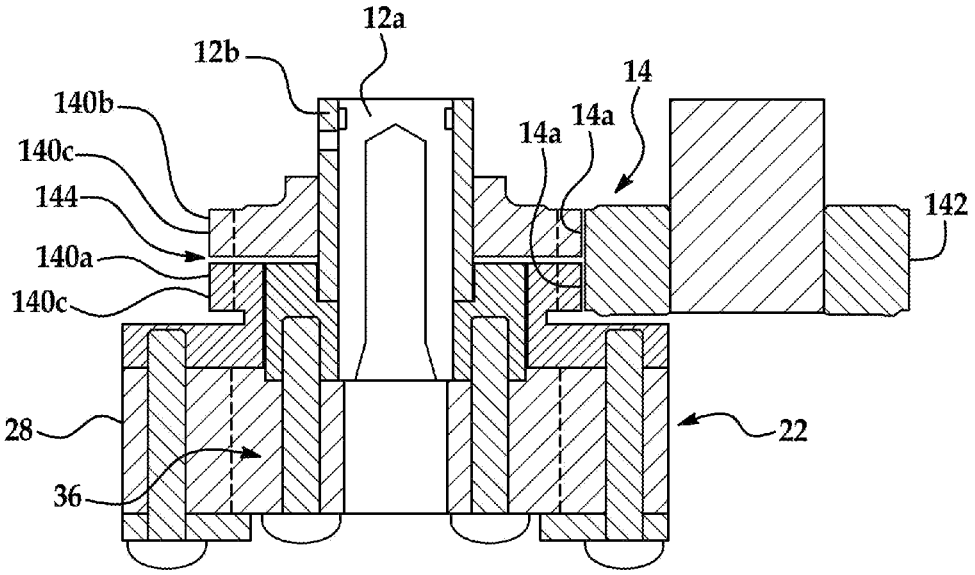
FIG. 3 is a cross sectional view of the cam phaser and concentric camshaft assembly of FIG. 1.

Referring now to FIGS. 1-3, the torsional drive mechanism 14 can include a driven gear 140 having an axis of rotation and transversely split into independent, separate, axially adjacent, first and second driven teeth portions 140*a*, 140*b*. The first driven teeth portion 140*a* can be connected to a housing portion 28 of the phaser 22 and the second driven teeth portion 140*b* can be connected to the outer camshaft 12*b*. A single common drive gear 142 can be assembled in driving engagement with both first and second driven teeth portions 140*a*, 140*b* of the driven gear 140. Alternatively, two separate drive gears, each of which is attached to the same common shaft, can be used to drive both driven gears. In operation, relative movement between the first and second driven teeth portions 140*a*, 140*b* of the driven gear 140 allows for adjustment for perpendicularity and axial misalignment of the inner and outer camshafts 12*a*, 12*b*, while maintaining a torsionally stiff coupling between a cam phaser 22 and one of the inner and outer camshafts 12*a*, 12*b* of the concentric camshaft 12. The assembly of the phaser 22 and inner camshaft 12*a* can adjust relative to the outer camshaft 12*b* due to a gap 144 between the first and second driven teeth portions 140*a*, 140*b* of the driven gear 140. In other words, the gap 144 between the first and second driven teeth portions 140*a*, 140*b* allows tipping or axial motion, such as axial run-out, of the first driven teeth portion 140*a* relative to the second driven teeth portion 140*b* to compensate for any perpendicularity and/or axial misalignments of the inner and outer camshafts 12*a*, 12*b*.

Figure 4:
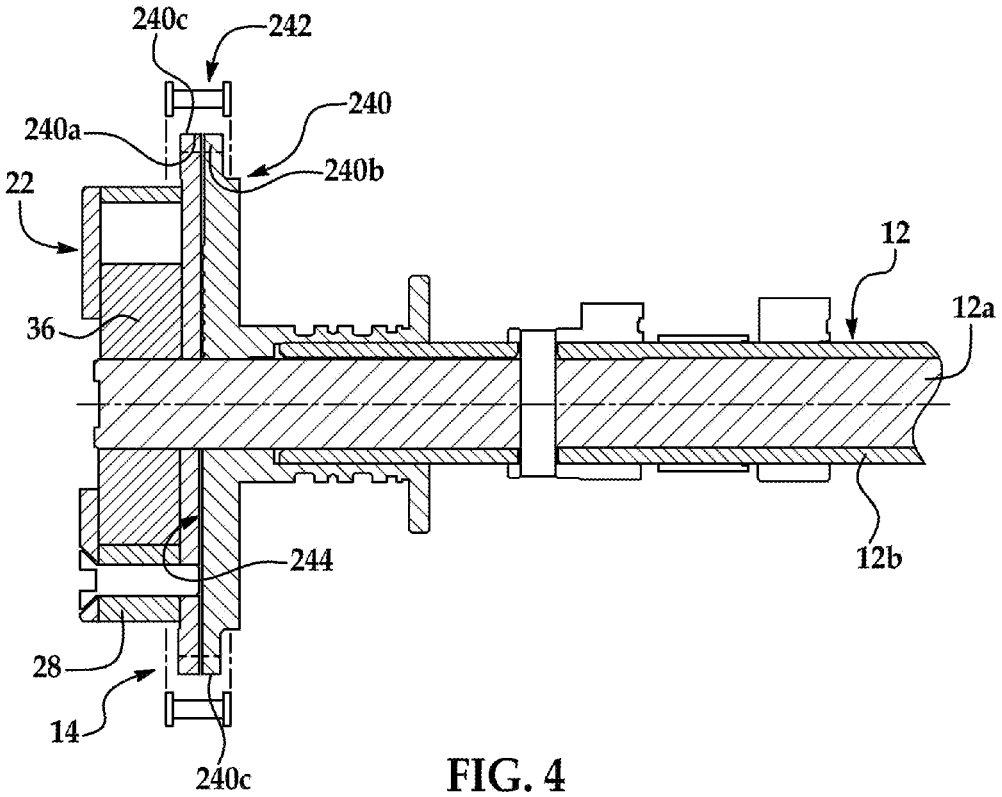
FIG. 4 is a cross sectional view of a cam phaser and concentric camshaft assembly including a housing portion, a rotor, a torsional drive mechanism, where the concentric camshaft has an inner camshaft and an outer camshaft and the torsional drive mechanism includes a split sprocket ring gear having one portion connected to the outer camshaft and another portion connected to the housing portion of the cam phaser.

Referring now to FIG. 4, the torsional drive mechanism 14 can include a driven sprocket ring gear 240 having an axis of rotation and transversely split into independent, separate, axially adjacent, first and second driven teeth portions 240*a*, 240*b*. The first driven teeth portion 240*a* can be connected to a housing portion 28 of the phaser 22 and the second driven teeth portion 240*b* can be connected to the outer camshaft 12*b*. A single common endless loop flexible drive member 242 can be assembled in driving engagement with both driven teeth portions 240*a*, 240*b* of the driven sprocket ring gear 240. In operation, relative movement between the first and second driven teeth portions 240*a*, 240*b* of the driven sprocket ring gear 240 allows for adjustment for perpendicularity and axial misalignment of the inner and outer camshafts 12*a*, 12*b*, while maintaining a torsionally stiff coupling between a cam phaser 22 and one of the inner and outer camshafts 12*a*, 12*b* of the concentric camshaft 12. The assembly of the phaser 22 and inner camshaft 12*a* can adjust relative to the outer camshaft 12*b* due to a gap 244 between the first and second driven teeth portions 240*a*, 240*b* of the driven sprocket ring gear 240. In other words, the gap 244 between the first and second driven teeth portions 240*a*, 240*b* allows tipping or axial motion, such as axial run-out, of the first driven teeth portion 240*a* relative to the second driven teeth portion 240*b* to compensate for any perpendicularity and/or axial misalignments of the inner and outer camshafts 12*a*, 12*b*. The split spur gear or split sprocket ring gear design also transmits torque between the cam phaser and the concentric camshaft system while allowing some axial motion between the two. This is done by separating the phaser and cam, which are usually rigidly fastened together, and instead driving each with its own spur gear or sprocket ring gear.

Figure 6:
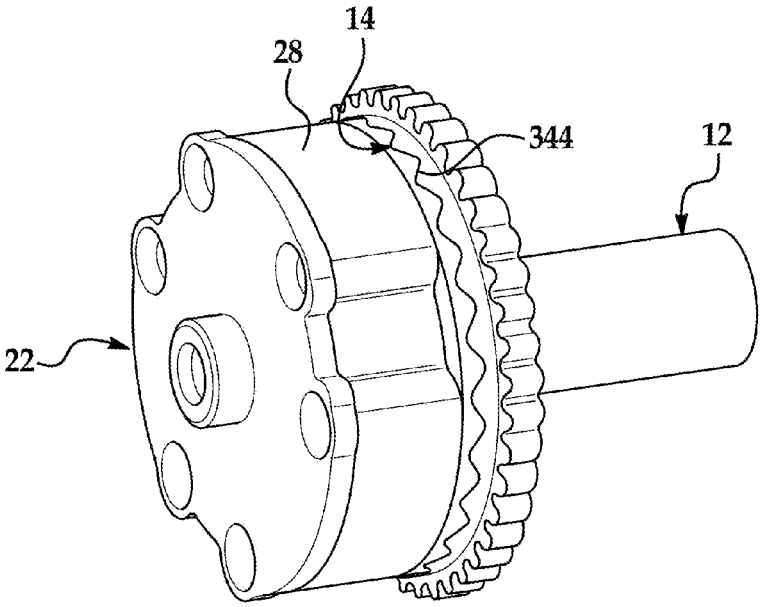
FIG. 6 is a perspective view of a cam phaser and concentric camshaft assembly including a housing portion, a rotor, a torsional drive mechanism, where the concentric camshaft has an inner camshaft and an outer camshaft.
Figure 7:
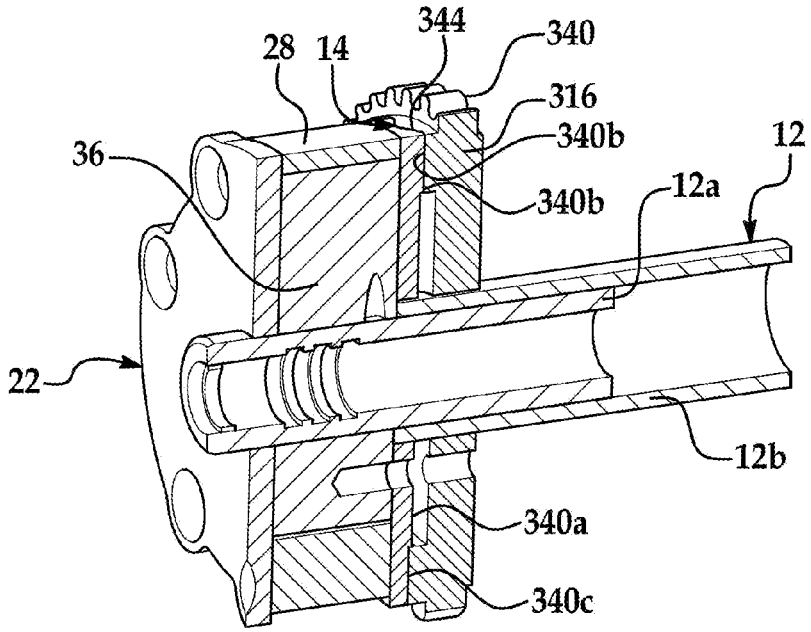
FIG. 7 is a cross sectional perspective view of the cam phaser and concentric camshaft of FIG. 6.
Figure 8:
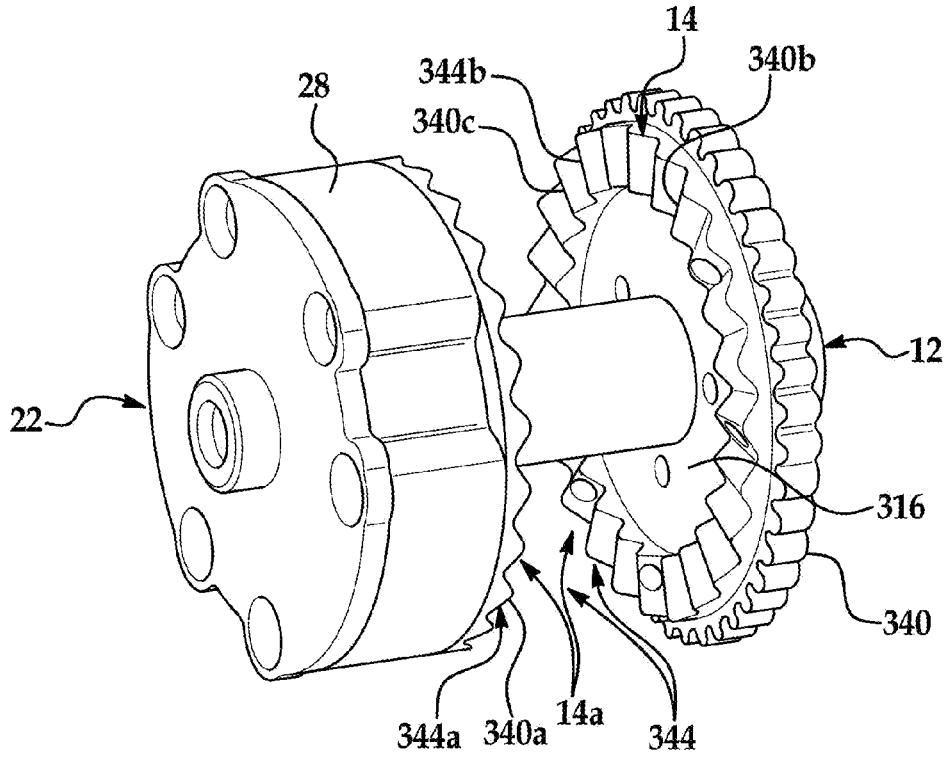
FIG. 8 is an exploded, view the cam phaser and concentric camshaft assembly of FIG. 6.
Figure 9:
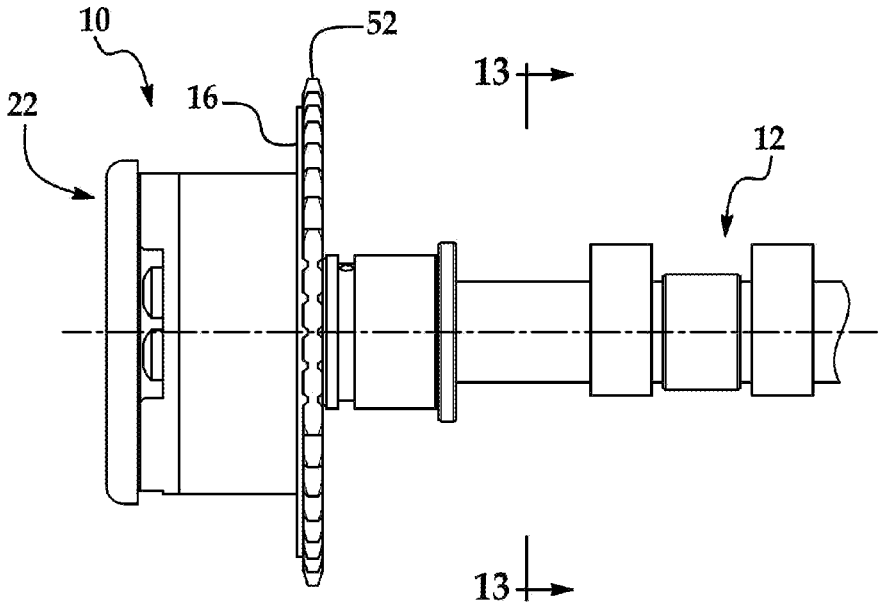
FIG. 9 is a side view of a cam phaser and concentric camshaft assembly including a housing, a rotor, a flexible shaft coupling, where the concentric camshaft has an inner camshaft and an outer camshaft.
Figure 10:
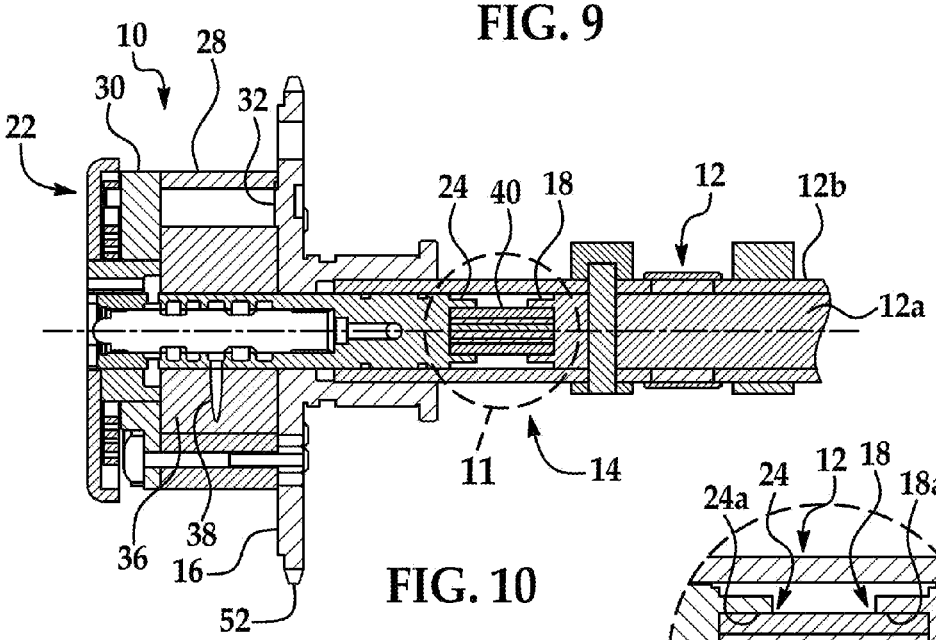
FIG. 10 is a cross section view taken as shown in FIG. 12 of the cam phaser and concentric camshaft assembly of FIG. 9.
Figure 11:
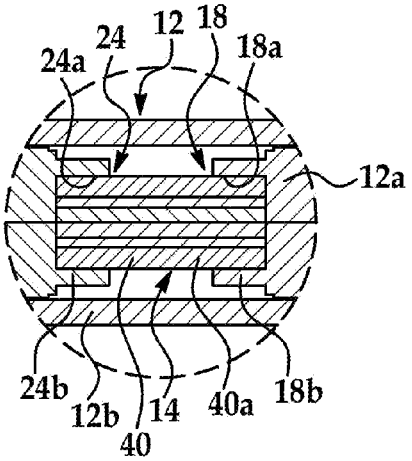
FIG. 11 is a detailed view of the flexible shaft coupling taken as shown in FIG. 10.
Figure 12:
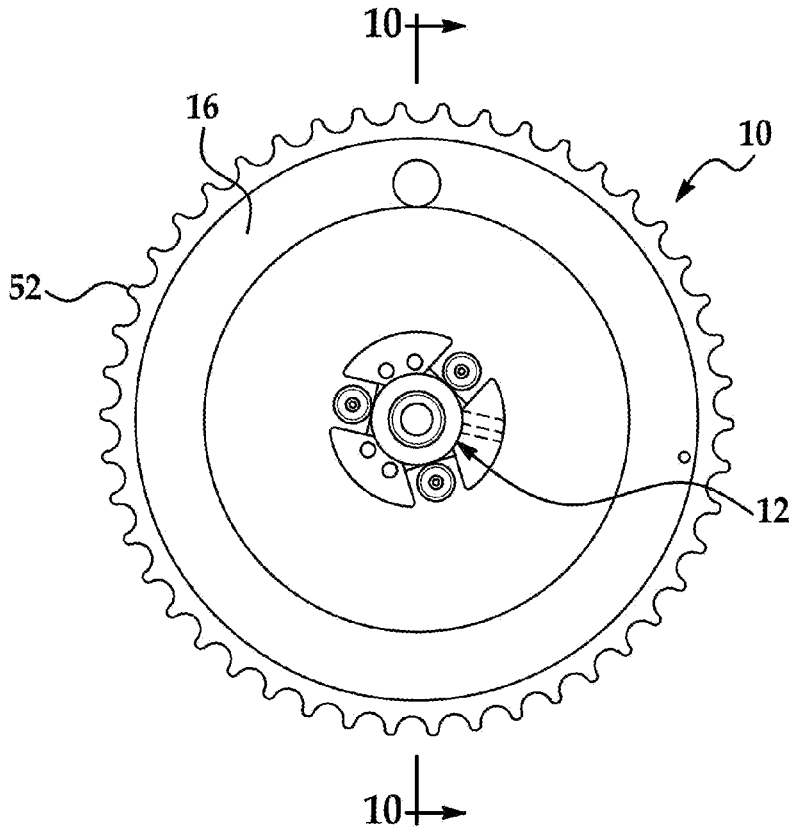
FIG. 12 is an end view of the cam phaser and concentric camshaft assembly of FIG. 9.
Figure 13:
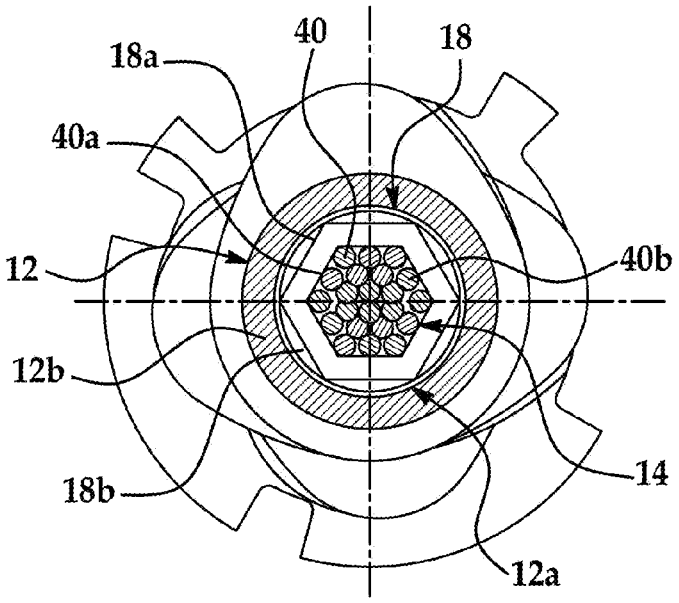
FIG. 13 is a cross section view taken as shown in FIG. 9 of the cam phaser and concentric camshaft assembly.

Referring now to FIGS. 6-8, the torsional drive mechanism 14 can include a pair of opposing transversely extending faces 344*a*, 344*b* between a housing portion 28 of the phaser 22 and a flange 316 of a sprocket ring gear 340. The transversely extending faces 344*a*, 344*b* can include a plurality of intermeshing teeth or face splines 340*a*, 340*b* assembled in driving engagement with one another. In operation, relative movement between the first and second teeth or face spline portions 340*a*, 340*b* of the phaser housing portion 28 and driving sprocket ring gear 340 allows for adjustment for perpendicularity and axial misalignments of the inner and outer camshafts 12*a*, 12*b*, while maintaining a torsionally stiff coupling between the cam phaser 22 and one of the inner and outer camshafts 12*a*, 12*b* of the concentric camshaft 12. The assembly of the phaser 22 and inner camshaft 12*a* can adjust relative to the outer camshaft 12*b* due to axially intermeshing teeth or face spline interface 344 between the first and second teeth or face spline portions 340*a*, 340*b* of the phaser 22 and driving sprocket ring gear 340. In other words, the interface 344 between the first and second teeth or face spline portions 340*a*, 340*b* allows tipping or axial motion, such as axial run-out, of the first driving teeth or spline portion 340*a* relative to the second driven teeth or spline portion 340*b* to compensate for any perpendicularity and/or axial misalignments of the inner and outer camshafts 12*a*, 12*b*.

The configuration illustrated in FIGS. 6-8 uses a face spline between the driving sprocket ring gear and the end plate of the phaser assembly. The face spline allows misalignment between the two components while still allowing torque transfer between the two components. The two components used in conjunction with one another will allow the transfer of torque while still providing the ability to take up errors in parallelism. This "compliant" joint provides a flexible joint to allow for misalignment between the inner and outer shafts of a concentric camshaft. The two parts are allowed to mesh through the face spline to allow torque transmittal. The fact that each component is affixed and positioned axially along the two different shafts allows the components to stay in constant mesh. The face spline allows typically longer meshing surfaces than a spline on a perpendicular surface. This in turn decreases the amount of backlash required to take up the same amount of parallelism error. For this device the axial positions will be maintained throughout operation therefore only allowing take-up of parallelism errors due to tolerances.

The described device is meant as a means of allowing assembly of a concentric cam based camshaft phaser while allowing misalignment of components as caused by manufacturing tolerances. In this case, the misalignment is meant to be taken up between the end plate of the phaser and the cam drive sprocket ring gear. By decoupling the end plate from the sprocket ring gear, the end plate is allowed to conform to the angular inclination of the rotor, as defined by the inner shaft. As the outer and inner end plates are bolted together through the phaser housing portion, the end plates can align with respect to the rotor. The sprocket ring gear is affixed rigidly to the outer shaft of the camshaft assembly. The orientation of the inner to outer shaft, and subsequently the rotor, along with housing portion and end plates assembly, to the cam driving sprocket ring gear is provided by the cam lobes. Since the end plate of the assembly is held in close proximity to the cam driving sprocket ring gear, a face spline can be used between the two components to provide a means of torque transmittal while also allowing for slight differences in parallelism between the two. Backlash between the two components should be minimized so that the assembly does not have poor noise, vibration, and harshness (NVH) performance.

It should be recognized from a comparison of FIGS. 1-3 and 6-8 that the first and second teeth or face spline portions 140*a*, 140*b*; 240*a*, 240*b*; 340*a*, 340*b* can be in any desired orientation. By way of example and not limitation, the first and second teeth or face spline portions 140*a*, 140*b*; 240*a*, 240*b*; 340*a*, 340*b* can be formed in an orientation with a face width direction 140*c*, 240*c*, 340*c* of the tooth profile extending in a radial direction along a face disposed angularly with respect to a longitudinal rotational axis of the concentric camshafts (FIGS. 6-8), or extending in a radial direction along a transverse face disposed normal or perpendicular to a longitudinal rotational axis of the concentric camshafts (FIGS. 6-8), or extending in a transverse direction with respect to a longitudinal rotational axis of the concentric camshafts and having a plurality of intersecting teeth (FIGS. 6-8), or extending in a transverse direction with respect to the longitudinal rotational axis of the concentric camshafts and having at least two groups of parallel teeth intersecting one another (not shown), or extending in an axial direction or longitudinal direction with respect to a longitudinal rotational axis of the concentric camshafts along a circumferential face (FIGS. 1-4). By way of example and not limitation, the face width of the tooth profile can extend in an axial direction as shown in FIGS. 1-4 for teeth 140*a*, 140*b*; 240*a*, 240*b* or in a radial direction as shown in FIGS. 6-8 for teeth or splines 340*a*, 340*b*; or any angular orientation therebetween (not shown). When extending in a radial direction as shown in FIGS. 6-8, the tooth profile can taper from a wider tooth profile at a radially outward position to a narrower tooth profile at a radially inward position.

Figure 5:
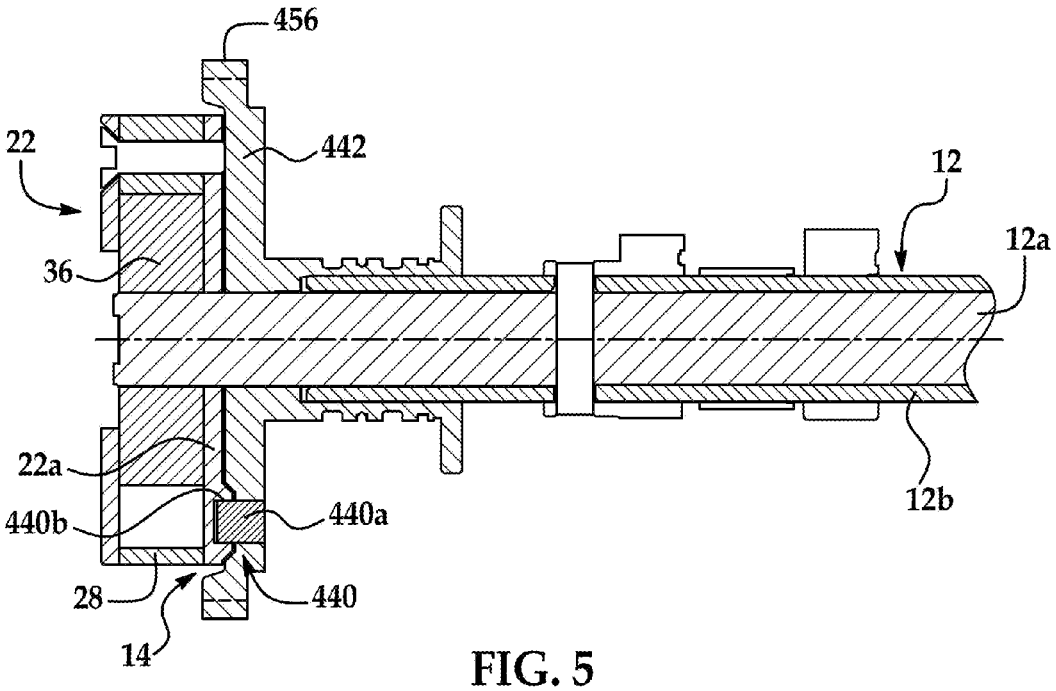
FIG. 5 is a cross sectional view of a cam phaser and concentric camshaft assembly including a housing portion, a rotor, a torsional chive mechanism, where the concentric camshaft has an inner camshaft and an outer camshaft and the torsional drive mechanism includes at least one drive pin captured within an aperture.

Referring now to FIG. 5, the torsional drive mechanism 14 can include a combination pin and slot drive mechanism 440 located between a housing wall portion 22*a* of the cam phaser 22 and a flange 442 of the sprocket ring gear 456. The pin drive connection uses a simple pin 440*a* as a torsional drive member between an inner housing wall portion 22*a* of the cam phaser 22 and one of the shafts of a concentric camshaft system. More particularly, the pin drive connection uses an interface between the flange 442 of the sprocket ring gear 456 and the inner housing wall portion 22*a* of the cam phaser 22. A pin 440*a* can be press fit into a mating part on one side, either on the flange 442 or the inner housing wall portion 22*a*, and engaged with a slip fit within an aperture or slot 440*b* on the other mating part, either the inner housing wall portion 22*a* or flange 442 respectively. This allows torque to be transmitted through the pin and slot combination while also allowing some tipping or axial run-out between the parts as the system rotates.

A variable cam timing assembly 10 for an internal combustion engine of a motor vehicle can have a cam phaser 22 connected between an inner camshaft 12*a* and an outer camshaft 12*b* of a concentric camshaft 12 for providing phased relative rotary motion between inner camshaft 12*a* and outer camshaft 12*b*. A torsional drive mechanism 14 can be connected between the cam phaser 22 and one of the inner and outer camshafts 12*a*, 12*b* of the concentric camshaft 12 for transmitting rotational torque. The torsional drive mechanism 14 can permit adjustment for perpendicularity and axial misalignment of the inner and outer camshafts 12*a*, 12*b* with respect to one another and/or with respect to the phaser 22, while maintaining a torsionally stiff coupling between the cam phaser 22 and one of the inner and outer camshafts 12*a*, 12*b* of the concentric camshaft 12. The torsional drive mechanism 14 can include complementary, operably engaged, shaped interface surfaces located between a driving member 142, 242, 342, 442 and at least one driven member 140, 240, 340, 440, or more particularly, by way of example and not limitation, such as driving gear 142 and driven gear 140 with driven teeth 140*a*, 140*b* (FIGS. 1-3), or endless loop power transmitting driving member 242 and driven sprocket ring gear 240 with sprocket teeth 240*a*, 240*b* (FIG. 4), or driving sprocket ring gear 456 with pin 440*a* and driven wall portion 28*a* with aperture 440*b* of cam phaser 22 (FIG. 5), or driving sprocket ring gear 342 with splines or teeth 340*a* and driven wall portion 28*a* with splines or teeth 340*b* of cam phaser 322 (FIGS. 6-8).

A variable cam timing assembly 10 for operating at least one poppet-type valve of an internal combustion engine of a motor vehicle can include a cam phaser 22 having a housing portion 28 enclosing a rotor 36 with an axis of rotation connected to a concentric camshaft 12 including an inner rotary camshaft 12*a* and an outer rotary camshaft 12*b*. A torsional drive mechanism 14 can be connectible between the cam phaser 22 and one of the inner and outer camshafts 12*a*, 12*b* of the concentric camshaft 12 for transmitting rotational torque therebetween. The torsional drive mechanism 14 can permit adjustment for perpendicularity and axial misalignment of the inner and outer camshafts 12*a*, 12*b* with respect to one another and/or with respect to the cam phaser 22, while maintaining a torsionally stiff coupling between the cam phaser 22 and the concentric camshaft 12. The torsional drive mechanism 14 can be formed from one of a transversely split driven gear 140, a transversely split sprocket ring gear 240, a transverse face spline gear 340, and a pin and slot combination drive 440.

A method of assembling a variable cam timing assembly 10 for an internal combustion engine of a motor vehicle having a cam phaser 22 to be connected between an inner camshaft 12*a* and an outer camshaft 12*b* of a concentric camshaft 12 can include connecting a torsional drive mechanism 14 between the cam phaser 22 and one of the inner and outer camshafts 12*a*, 12*b* of the concentric camshaft 12 for transmitting rotational torque. The torsional drive mechanism 14 can permit adjustment for perpendicularity and axial misalignment of the inner and outer camshafts 12*a*, 12*b* with respect to one another and/or with respect to the cam phaser 22, while maintaining a torsionally stiff coupling between the cam phaser 22 and one of the inner and outer camshafts 12*a*, 12*b* of the concentric camshaft 12. The method can also include assembling one of a transversely split driven gear 140, a transversely split sprocket ring gear 240, a transverse face spline gear 340, and a pin and slot combination drive 440 between the driving member and the driven portion of the inner and outer camshafts 12*a*, 12*b*.

In operation, the torsional drive mechanism 14 is located between one of the inner and outer camshafts 12*a*, 12*b* and the phaser 22. The torsional drive mechanism 14 accommodates misalignment of the inner and outer camshafts 12*a*, 12*b* with respect to one another and/or with respect to a joint with the rotor 36 or housing portion 28 of the cam phaser 22, which if uncorrected could cause the rotor 36 to bind within the housing portion 28 of the cam phaser 22. The torsional drive mechanism 14 adjust for perpendicularity and axial misalignment between the inner and outer camshafts 12*a*, 12*b* and the phaser 22 assembly, while maintaining a torsionally stiff coupling between one of the inner and outer camshafts 12*a*, 12*b* and the rotor 36 or housing portion 28 of the phaser 22. The torsional drive mechanism 14 permits limited perpendicularity and axial realignment of the rotor 36 or housing portion 28 of the phaser 22 with respect to one of the inner and outer camshafts 12*a*, 12*b* while transmitting torque and rotation movement between the rotor 36 and inner camshaft 12*a*, or housing portion 28 and outer camshaft 12*b*, in either rotational direction. The inner camshaft 12*a* remains free to rotate relative to the outer camshaft 12*b* in response to actuation of phaser 22, as both inner and outer camshafts 12*a*, 12*b* of the concentric camshaft 12 are driven in rotation.

Referring now to FIGS. 9-13, a portion of a variable cam timing (VCT) assembly 10 is illustrated including a concentric camshaft 12 having an inner camshaft 12*a* and an outer camshaft 12*b*. Primary rotary motion can be transferred to the concentric camshaft 12 through the assembly of sprocket ring 52 to annular flange 16 operably associated with outer camshaft 12*b*. Secondary rotary motion, or phased relative rotary motion between inner camshaft 12*a* and outer camshaft 12*b*, can be provided by a cam phaser or other mechanical actuator 22. Cam phasers 22 require precise tolerances and alignment to function properly. Misalignment between the inner camshaft 12*a* and the outer camshaft 12*b* of the concentric camshaft 12 can create problems preventing proper function of the cam phaser 22. The torsional drive mechanism 14 can include a flexible shaft coupling 40 to compensate for misalignment between inner camshaft 12*a* and outer camshaft 12*b* of the concentric camshaft 12 and cam phaser 22. An annular flange 16 can be operably associated with the outer camshaft 12*b*. A flexible shaft coupling 40 can be connected to the inner camshaft 12*a* by a non-circular complementary male-female shaped coupling 18 having one end portion 18*a* connected to a body 40*a* of the flexible shaft coupling 40. A mechanical actuator or cam phaser 22 can be operably associated with an inner camshaft 12*a*. From an opposite side of the flexible shaft coupling 40, the flexible shaft coupling 40 can be connected to the rotor 36 of the cam phaser 22 by a non-circular complementary male-female shaped coupling 24 having one end portion 24*a* connected to the body 40*a* of the flexible shaft coupling 40. Rotor 36 can be pressed onto the inner camshaft 12*a* and secured with a pin 38. The rotor 36 can be housed between the inner plate 32, the housing 28, and the outer plate 30.

A variable cam timing assembly 10 for an internal combustion engine of a motor vehicle can have a cam phaser 22 connected between an inner camshaft 12*a* and an outer camshaft 12*b* of a concentric camshaft 12 for providing phased relative rotary motion between inner camshaft 12*a* and outer camshaft 12*b*. The torsional drive mechanism 14 can include a flexible shaft coupling 40 connected between the cam phaser 22 and the inner camshaft 12*a* of the concentric camshaft 12 for transmitting rotational torque. The flexible shaft coupling 40 can have a flexible body 40*a* permitting adjustment for perpendicularity and axial misalignment, while maintaining a torsionally stiff coupling between the cam phaser 22 and at least one of the inner and outer camshafts 12*a*, 12*b* of the concentric camshaft 12.

The flexible shaft coupling 40 can be a torque transmitting cable assembly. The flexible shaft coupling 40 can include a plurality of spiral wound strands 40*b* joined together to preclude unraveling thereof and connected at one end to the inner camshaft 12*a* and to the cam phaser 22 at another end. The spiral wound strands can include metallic strands 40*b* welded together and connected at one end to the inner camshaft 12*a* and to the cam phaser 22 at an opposite end. At least one male-female shaped coupling 18, 24 having an end portion 18*a*, 24*a* of non-circular cross-section can be provided on the flexible shaft coupling 40 for attachment to a complementary corresponding male-female shaped fitting 18*b*, 24*b* located on one of the inner camshaft 12*a* and the cam phaser 22. It should be recognized that the flexible shaft coupling 40 can be formed with either a male or female mating end portion 18*a*, 24*a* for engagement with a complementary female or male mating end of the corresponding complementary male-female shaped fittings 18*b*, 24*b* formed on the inner camshaft 12*a* and/or cam phaser 22. The flexible shaft coupling 40 can be constructed of at least one of wound cable, wound steel, and wound plastic, and any combination thereof. At least one male-female shaped coupling 18, 24 can be non-rotatably joined with the flexible shaft coupling 40. The flexible shaft coupling 40 can be at least partially sheathed within the outer camshaft 12*b*.

A variable cam timing assembly 10 for operating at least one poppet-type valve of an internal combustion engine of a motor vehicle can include a cam phaser 22 having a housing 28, 30, 32 at least partially enclosing a rotor 36 with an axis of rotation connected to a concentric camshaft 12 including an inner rotary camshaft 12*a* and an outer rotary camshaft 12*b*. The torsional drive mechanism 14 can include an elongate flexible shaft coupling 40 can have one end connectible between the rotor 36 of the cam phaser 22 and another end connectible to the inner camshaft 12*a* of the concentric camshaft 12 for transmitting rotational torque therebetween. The elongate flexible shaft coupling 40 can have a flexible body 40*a* permitting adjustment for perpendicularity and axial misalignment, while maintaining a torsionally stiff coupling between the cam phaser 22 and the concentric camshaft 12. The flexible shaft coupling 40 can be formed of a torque transmitting cable assembly. At least one end of the elongate flexible shaft coupling 40 can have a non-circular periphery for making a driving connection with at least one of the rotor 36 and the inner camshaft 12*a*.

A method of assembling a variable cam timing assembly 10 for an internal combustion engine of a motor vehicle having a cam phaser 22 to be connected between an inner camshaft 12*a* and an outer camshaft 12*b* of a concentric camshaft 12 can include connecting the torsional drive mechanism 14, where the torsional drive mechanism 14 includes a flexible shaft coupling 40 between the cam phaser 22 and the inner camshaft 12*a* of the concentric camshaft 12 for transmitting rotational torque. The flexible shaft coupling 40 can have a flexible body 40*a* permitting adjustment for perpendicularity and axial misalignment, while maintaining a torsionally stiff coupling between the cam phaser 22 and at least one of the inner and outer camshafts 12*a*, 12*b* of the concentric camshaft 12. The method can also include forming at least one complementary male-female shaped coupling 18, 24 having an end portion 18*a*, 24*a* of non-circular cross-section for attachment of at least one end of the flexible shaft coupling 40 to the inner camshaft 12*a* and to the cam phaser 22. The male-female shaped coupling 18, 24 can be assembled by coupling at least one end portion 18*a*, 24*a* of non-circular cross-section complementary male-female shaped couplings 18, 24 with respect to a complementary corresponding male-female shaped fittings 18*b*, 24*b* for attachment of one end of the flexible shaft coupling 40 to at least one of the inner camshaft 12*a* at one end and the cam phaser 22 at an opposite end. The flexible shaft coupling 40 can be formed by joining spiral wound strands 40*b* together to define the flexible shaft coupling 40 and to preclude unraveling thereof. At least one end of the flexible shaft coupling 40 can be connected to at least one of the inner camshaft 12*a* and the cam phaser 22.

In operation, the flexible shaft coupling 40 is located between the inner camshaft 12*a* and the rotor 36 of the phaser 22. The flexible shaft coupling 40 accommodates misalignment of the inner camshaft 12*a* with respect to the joint with the rotor 36, which if uncorrected could cause the rotor 36 to bind within the housing 28, 30, 32 of the cam phaser 22. The flexible shaft coupling 40 for the rotor 36 of the phaser 22 to adjust for perpendicularity, and axial misalignment, while maintaining a torsionally stiff coupling between the inner camshaft 12*a* and the rotor 36. The flexible shaft coupling 40 permits limited perpendicularity and axial realignment of the rotor 36 with respect to the inner camshaft 12*a* while transmitting torque and rotation movement between the rotor 36 and inner camshaft 12*a* in either rotational direction. The inner camshaft 12*a* remains free to rotate relative to the outer camshaft 12*b* in response to phaser 22 actuation, as both inner and outer camshafts 12*a*, 12*b* of the concentric camshaft 12 are driven in rotation by the sprocket ring 52 and annular flange 16 assembly.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In a variable cam timing assembly (10) for an internal combustion engine of a motor vehicle having a cam phaser (22) connected between an inner camshaft (12*a*) and an outer camshaft (12*b*) of a concentric camshaft (12), the improvement comprising:

a torsional drive mechanism (14) connected between the inner camshaft (12*a*) and the outer camshaft (12*b*) of the concentric camshaft (12) for transmitting rotational torque therebetween, the torsional drive mechanism (14) permitting adjustment for perpendicularity and axial misalignment, while maintaining a torsionally stiff coupling between the cam phaser (22) and at least one of the inner and outer camshafts (12*a*, 12*b*) of the concentric camshaft (12), wherein the torsional drive mechanism (14) includes a plurality of driven teeth (14*a*) connected to a housing portion (28) of the cam phaser (22), wherein the plurality of driven teeth (14*a*) of the torsional drive mechanism (14) includes a driven gear (140) having an axis of rotation and transversely split into a first driven teeth portion (140*a*) connected to the housing portion (28) of the phaser (22) and a second driven teeth portion (140*b*) connected to the outer camshaft (12*b*).

2. The improvement of claim 1 further comprising:

a single common drive gear (142) in driving engagement with both first and second driven teeth portions (140*a*, 140*b*) of the driven gear (140).

3. In a variable cam timing assembly (10) for an internal combustion engine of a motor vehicle having a cam phaser (22) connected between an inner camshaft (12*a*) and an outer camshaft (12*b*) of a concentric camshaft (12), the improvement comprising:

a torsional drive mechanism (14) connected between the inner camshaft (12*a*) and the outer camshaft (12*b*) of the concentric camshaft (12) for transmitting rotational torque therebetween, the torsional drive mechanism (14) permitting adjustment for perpendicularity and axial misalignment, while maintaining a torsionally stiff coupling between the cam phaser (22) and at least one of the inner and outer camshafts (12*a*, 12*b*) of the concentric camshaft (12), wherein the torsional drive mechanism (14) includes a plurality of driven teeth (14*a*) connected to a housing portion (28) of the cam phaser (22), wherein the plurality of driven teeth (14*a*) of the torsional drive mechanism (14) includes a driven sprocket ring gear (240) having an axis of rotation and transversely split into a first driven teeth portion (240*a*) connected to the housing portion (28) of the phaser (22) and a second driven teeth portion (240*b*) connected to the outer camshaft (12*b*).

4. The improvement of claim 3 further comprising:

a common endless loop flexible drive member (242) in driving engagement with both driven teeth portions (240*a*, 240*b*) of the driven sprocket ring gear (240).

5. In a variable cam timing assembly (10) for an internal combustion engine of a motor vehicle having a cam phaser (22) connected between an inner camshaft (12*a*) and an outer camshaft (12*b*) of a concentric camshaft (12), the improvement comprising:

a torsional drive mechanism (14) connected between the inner camshaft (12*a*) and the outer camshaft (12*b*) of the concentric camshaft (12) for transmitting rotational torque therebetween, the torsional drive mechanism (14) permitting adjustment for perpendicularity and axial misalignment, while maintaining a torsionally stiff coupling between the cam phaser (22) and at least one of the inner and outer camshafts (12*a*, 12*b*) of the concentric camshaft (12), wherein the torsional drive mechanism (14) includes a flexible shaft coupling (40) defined by a torque transmitting cable assembly, wherein the flexible shaft coupling (40) includes spiral wound strands (40*b*) joined together to preclude unraveling thereof and connected at one end to the inner camshaft (12*a*) and to the cam phaser (22) at an opposite end.

6. In a variable cam timing assembly (10) for an internal combustion engine of a motor vehicle having a cam phaser (22) connected between an inner camshaft (12*a*) and an outer camshaft (12*b*) of a concentric camshaft (12), the improvement comprising:

a torsional drive mechanism (14) connected between the inner camshaft (12*a*) and the outer camshaft (12*b*) of the concentric camshaft (12) for transmitting rotational torque therebetween, the torsional drive mechanism (14) permitting adjustment for perpendicularity and axial misalignment, while maintaining a torsionally stiff coupling between the cam phaser (22) and at least one of the inner and outer camshafts (12*a*, 12*b*) of the concentric camshaft (12), wherein the torsional drive mechanism (14) includes a flexible shaft coupling (40) defined by a torque transmitting cable assembly at least one complementary male-female shaped coupling (18, 24) having an end portion (18*a*, 24*a*) of non-circular cross-section for attachment to a complementary male-female shaped fitting (18*b*, 24*b*) located on one of the inner camshaft (12*a*) and the cam phaser (22).

7. A method of assembling a variable cam timing assembly (10) for an internal combustion engine of a motor vehicle having a cam phaser (22) connected between an inner camshaft (12*a*) and an outer camshaft (12*b*) of a concentric camshaft (12) comprising:

connecting a torsional drive mechanism (14) between the inner camshaft (12*a*) and the outer camshaft (12*b*) of the concentric camshaft (12) for transmitting rotational torque, the torsional drive mechanism (14) permitting adjustment for perpendicularity and axial misalignment, while maintaining a torsionally stiff coupling between the cam phaser (22) and at least one of the inner and outer camshafts (12*a*, 12*b*) of the concentric camshaft (12); and forming a plurality of driven teeth (14*a*) on the torsional drive mechanism (14) connected to a housing portion (28) of the cam phaser (22), wherein forming the plurality of driven teeth (14*a*) of the torsional drive mechanism (14) includes forming a driven gear (140) having an axis of rotation and transversely split into a first driven teeth portion (140*a*) connected to the housing portion (28) of the phaser (22) and a second driven teeth portion (140*b*) connected to the outer camshaft (12*b*), and assembling a single common drive gear (142) in driving engagement with both first and second driven teeth portions (140*a*, 140*b*) of the driven gear (140).

8. A method of assembling a variable cam timing assembly (10) for an internal combustion engine of a motor vehicle having a cam phaser (22) connected between an inner camshaft (12*a*) and an outer camshaft (12*b*) of a concentric camshaft (12) comprising:

connecting a torsional drive mechanism (14) between the inner camshaft (12*a*) and the outer camshaft (12*b*) of the concentric camshaft (12) for transmitting rotational torque, the torsional drive mechanism (14) permitting adjustment for perpendicularity and axial misalignment, while maintaining a torsionally stiff coupling between the cam phaser (22) and at least one of the inner and outer camshafts (12*a*, 12*b*) of the concentric camshaft (12); and forming a plurality of driven teeth (14*a*) on the torsional drive mechanism (14) connected to a housing portion (28) of the cam phaser (22), wherein forming the plurality of driven teeth (14*a*) of the torsional drive mechanism (14) includes forming a driven sprocket ring gear (240) having an axis of rotation and transversely split into a first driven teeth portion (240*a*) connected to the housing portion (28) portion of the phaser (22) and a second driven teeth portion (240*b*) connected to the outer camshaft (12*b*), and assembling a common drive chain (242) in driving engagement with both driven teeth portions (240*a*, 240*b*) of the driven sprocket ring gear (240).

9. A method of assembling a variable cam timing assembly (10) for an internal combustion engine of a motor vehicle having a cam phaser (22) connected between an inner camshaft (12*a*) and an outer camshaft (12*b*) of a concentric camshaft (12) comprising:

connecting a torsional drive mechanism (14) between the inner camshaft (12*a*) and the outer camshaft (12*b*) of the concentric camshaft (12) for transmitting rotational torque, the torsional drive mechanism (14) permitting adjustment for perpendicularity and axial misalignment, while maintaining a torsionally stiff coupling between the cam phaser (22) and at least one of the inner and outer camshafts (12*a*, 12*b*) of the concentric camshaft (12); and forming a plurality of driven teeth (14*a*) on the torsional drive mechanism (14) connected to a housing portion (28) of the cam phaser (22), wherein forming the plurality of driven teeth (14*a*) of the torsional drive mechanism (14) includes forming a plurality of intermeshing teeth (340*a*, 340*b*) on a pair of opposing transversely extending faces (344*a*, 344*b*) connecting a housing portion (28) of the phaser (22) and a flange (316) of a sprocket ring gear (356).

10. A method of assembling a variable cam timing assembly (10) for an internal combustion engine of a motor vehicle having a cam phaser (22) connected between an inner camshaft (12*a*) and an outer camshaft (12*b*) of a concentric camshaft (12) comprising:

connecting a torsional drive mechanism (14) between the inner camshaft (12*a*) and the outer camshaft (12*b*) of the concentric camshaft (12) for transmitting rotational torque, the torsional drive mechanism (14) permitting adjustment for perpendicularity and axial misalignment, while maintaining a torsionally stiff coupling between the cam phaser (22) and at least one of the inner and outer camshafts (12*a*, 12*b*) of the concentric camshaft (12); and connecting a flexible shaft coupling (40) between the cam phaser (22) and the inner camshaft (12*a*) of the concentric camshaft (12) for transmitting rotational torque, the flexible shaft coupling (40) having a flexible body (40*a*) permitting adjustment for perpendicularity and axial misalignment, while maintaining a torsionally stiff coupling between the cam phaser (22) and at least one of the inner and outer camshafts (12*a*, 12*b*) of the concentric camshaft (12).

11. The method of claim 10 further comprising:

joining spiral wound strands (40*b*) together to define the flexible shaft coupling (40) and to preclude unraveling thereof;

forming at least one complementary male-female shaped coupling (18, 24) having an end portion (18*a*, 24*a*) of non-circular cross-section for attachment of at least one end of the flexible shaft coupling (40) to one of the inner camshaft (12*a*) and the cam phaser (22); and connecting the at least one end of the flexible shaft coupling (40) to at least one of the inner camshaft (12*a*) and the cam phaser (22).

* * * * *